US005114034A

United States Patent [19]

Miller et al.

[11] Patent Number: 5,114,034

[45] Date of Patent: May 19, 1992

[54] UTILITY TOTE CONTAINER WITH UNFASTENABLE AND REFASTENABLE SIDE WALLS AND END WALLS

[75] Inventors: Leroy Miller, Minneapolis; Mark S. Stoll, Deephaven, both of Minn.

[73] Assignee: Liberty Diversified Industries, New Hope, Minn.

[21] Appl. No.: 643,508

[22] Filed: Jan. 22, 1991

[51] Int. Cl.[5] ..... B65D 8/14

[52] U.S. Cl. ..... 220/7; 220/62; 220/690; 229/114; 229/182; 229/195

[58] Field of Search ..... 220/4.28, 4.33, 6, 7, 220/441, 94 A, 62, 660, 675, 690, 692; 229/114, 165, 182, 195

[56] References Cited

U.S. PATENT DOCUMENTS

| | | | |
|---|---|---|---|
| 1,041,872 | 10/1912 | Regenstein | 229/195 |
| 2,967,654 | 11/1961 | Palmer | 220/62 X |
| 3,226,006 | 12/1965 | Dunn | 229/195 |
| 3,360,180 | 12/1967 | Venturi | 220/7 |
| 3,393,859 | 7/1968 | Giummo | 229/195 X |
| 3,446,415 | 5/1969 | Bromley | 220/62 |
| 3,497,127 | 2/1970 | Box | 220/7 |
| 3,889,837 | 6/1975 | Wilson | 220/7 |
| 4,682,727 | 7/1987 | Stoll | 229/915 |
| 4,709,852 | 12/1987 | Stoll | 229/119 |
| 4,762,270 | 8/1988 | Stoll et al. | 229/23 A |
| 4,787,515 | 11/1988 | Stoll | 206/509 |
| 4,919,267 | 4/1990 | Stoll | 206/507 |
| 5,020,717 | 6/1991 | Cassidy | 229/114 |

*Primary Examiner*—Stephen Marcus

*Assistant Examiner*—Stephen Cronin

*Attorney, Agent, or Firm*—Moore & Hansen

[57] ABSTRACT

A utility tote container comprising a base panel, a pair of side wall panels, and a pair of end wall panels hingedly connected to the base panel. A pair of end foldover panels are hingedly connected to each end wall panel. The side wall panels and end wall panels are pivoted upwardly to an upright configuration, and the end foldover panels are folded inwardly into parallel abutting contact with the exterior planar surface of the adjacent side wall panel. End panel securing flaps are hingedly connected to each of the end foldover panels, and are received through aligned and correspondingly sized slots in the side wall panels. The end wall securing flaps are folded into parallel abutting contact with the interior planar surface of the adjacent side wall panel, and are secured thereto using a releasable fastener such as mating hook and loop type fasteners. Each end wall panel defines a centered handgrip opening, and a folded rim or shoulder extending along the length of the top edge of the end wall panel. The portion of the end wall panel cut away to form the handgrip opening is folded upwardly across double scored fold lines, and into the interior of the shoulder between the end wall panel and the portion of the end wall panel folded downwardly to form the shoulder, thereby presenting two double-thickness folds of corrugated sheet material at the top of the handgrip opening to provide greater supporting surface or purchase when a user lifts the utility tote container.

15 Claims, 3 Drawing Sheets

UTILITY TOTE CONTAINER WITH UNFASTENABLE AND REFASTENABLE SIDE WALLS AND END WALLS

BACKGROUND OF THE INVENTION

This invention relates generally to tapered nestable utility tote containers of the type fabricated from corrugated sheet materials, and particularly to a utility tote container having side walls and end walls that may be unfastened so the tote container may be unfolded to a flat blank, and refolded to an upright configuration and refastened.

A suitable reference point for considering the state of the prior art for tote containers of the type fabricated from a generally planar blank of corrugated sheet material is U.S. Pat. No. 4,682,727 to Stoll. The Stoll '727 patent discloses a tapered nestable utility tote container fabricated from double-faced corrugated plastic sheet material such as polyethylene, with the planar blank being cut and scored to form a variety of panels which are folded to an upright configuration and permanently secured in that configuration using sonic welds or a similar fastening means. The Stoll '727 tote container additionally discloses handgrip openings and a folded upper rim or shoulder for stacking and reinforcement.

Other types of tote containers fabricated from similar corrugated sheet materials but designed to be utilized in specific situations are shown in U.S. Pat. Nos. 4,709,852; 4,919,267; and 4,787,515, which disclose various nesting and stacking features, handle and lid assemblies, and the like.

Various types of tote containers are also known that may be folded or collapsed for storage or shipping. One representative example of such a tote container is disclosed in U.S. Pat. No. 4,762,270 to Stoll. The Stoll '270 tote container is constructed from two oppositely oriented blanks of corrugate sheet material pivotally connected to a metal rim member. The blanks may be folded upwardly to a generally flat configuration, and then snapped downwardly and engaged with one another to lock the tote container in an upright and open configuration.

The above referenced utility tote containers do present some limitations for particular uses. The side walls of the tote containers cannot be opened to permit unrestricted access to the interior receptacle regions from the sides or ends, and the tote containers cannot not be unfastened and folded to a flat configuration approximating the original configuration of the blank or blanks.

BRIEF SUMMARY OF THE INVENTION

It is therefore one object of this invention to design a utility tote container of the tapered nestable type that may be fabricated from a corrugated plastic sheet material, and in which the side walls and end walls may be selectively and repeatedly folded and secured in an upright tote container configuration and unfastened and folded downwardly to a flat configuration.

It is a related object of this invention to design the above utility tote container such that one of the side walls may be unfastened and folded downwardly to expose the interior receptacle region of the tote container independent of the end walls and the opposing side wall.

It is yet another object of this invention to design the above utility tote container such that it may be easily and inexpensively fabricated and constructed when compared to conventional utility tote containers in which the side walls and end walls are permanently secured in the upright configuration.

It is a further object of this invention to design the above utility tote container such that it incorporates a hand grip configuration which provides greater a gripping and lifting area on which the tote container rests when lifted by a user, thereby providing more comfort for the user, and a more stable end wall construction.

Briefly described, the utility tote container of this invention comprises a base panel and a pair of side wall panels and a pair of end wall panels hingedly connected to the base panel. A pair of end foldover panels are hingedly connected to each of the end wall panels. The side wall panels and end wall panels may be pivoted upwardly to an upright configuration, and the end foldover panels are each folded inwardly into parallel abutting contact with the exterior planar surface of the adjacent side wall panel. End panel securing flaps are hingedly connected to each of the end foldover panels, and are received through aligned and correspondingly sized slots in the side wall panels. The end wall securing flaps are folded into parallel abutting contact with the interior planar surface of the adjacent side wall panel, and are secured thereto using a releasable fastener such as mating hook and loop type fasteners. Each end wall panel defines a centered handgrip opening, and a folded rim or shoulder extending along the length of the top edge of the end wall panel. The portion of the end wall panel cut away to form the handgrip opening is folded upwardly across double scored fold lines, and into the interior of the shoulder between the end wall panel and the portion of the end wall panel folded downwardly to form the shoulder, thereby presenting two double-thickness folds of corrugated sheet material at the top of the handgrip opening to provide greater supporting surface or purchase when a user lifts the utility tote container.

DESCRIPTION OF THE PREFERRED EMBODIMENT

The tote container of this invention is shown in FIGS. 1-7 and referenced generally therein by the numeral 10.

Figure 1:
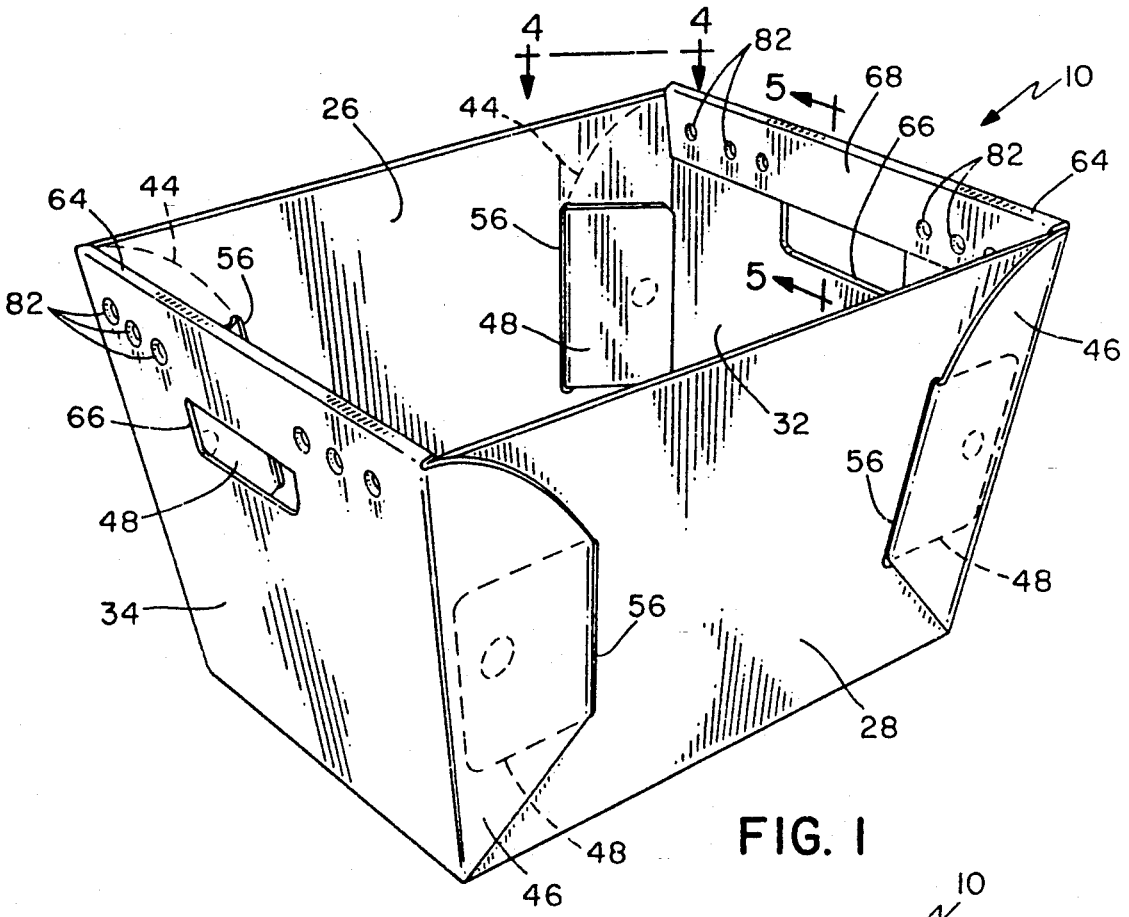
FIG. 1 is a perspective view of the tote container of this invention in the upright tote container configuration.

Referring particularly to FIG. 1, the tote container 10 is shown folded to a generally upright tote container configuration, in which the tote container forms a tapered and inverted trapezoidal pyramid (or truncated inverted four-sided pyramid) that is nestable with other like tote containers 10 of similar size and construction.

Figure 6:
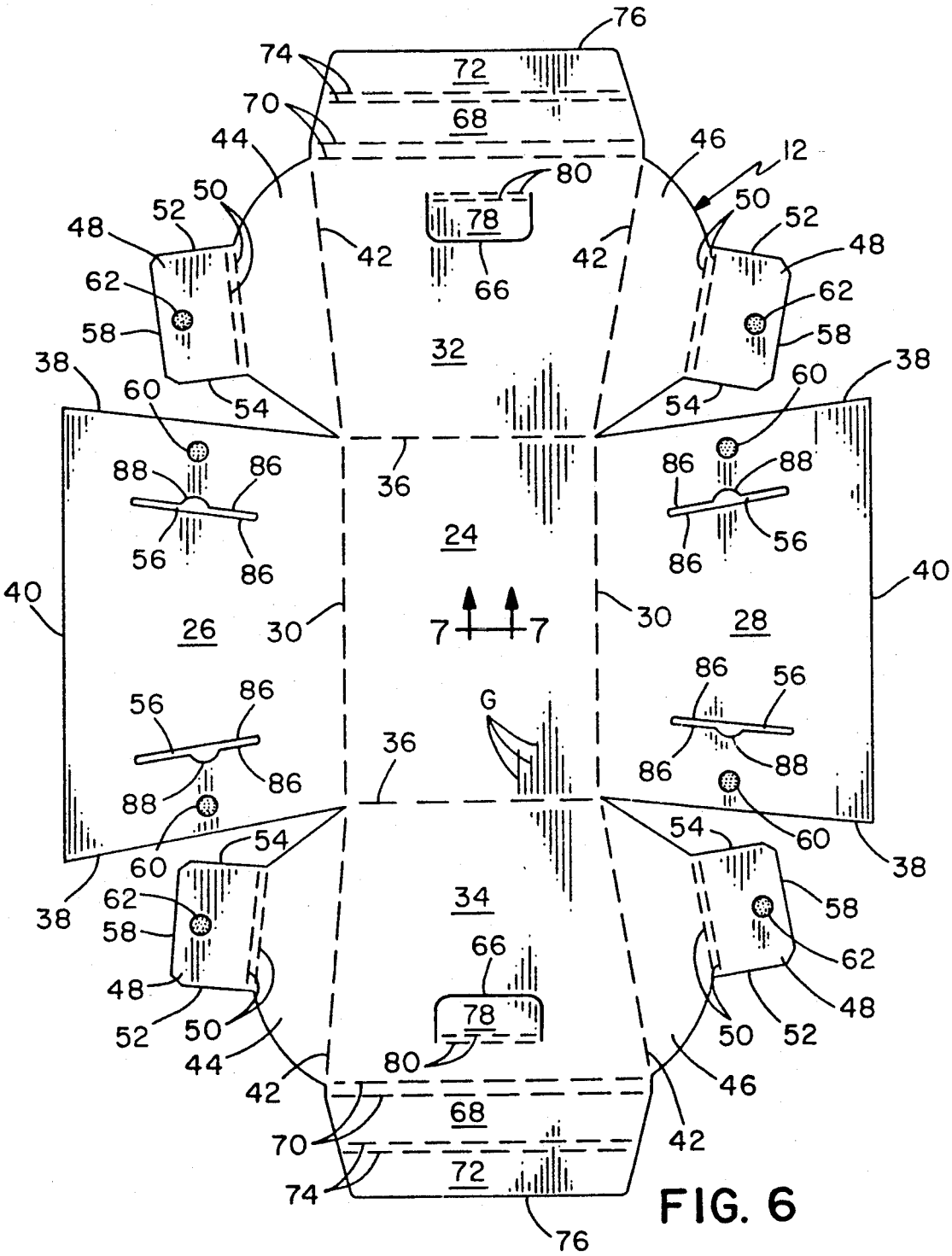
FIG. 6 is a top plan view of the generally planar blank used to form the tote container of FIG. 1.

Referring to FIG. 6, it may be seen that the tote container 10 may be folded to the upright configuration from a generally planar blank 12 of corrugated sheet material 14.

Figure 7:
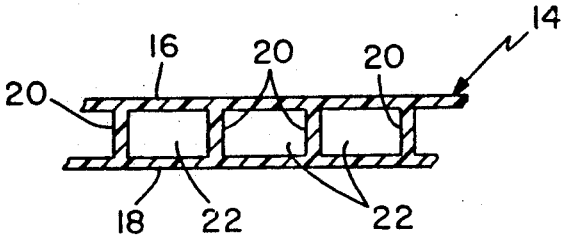
FIG. 7 is a diagrammatic cross section view of the double-faced corrugated plastic sheet material used to fabricate the tote container of this invention taken through line 7—7 in FIG. 6.

Referring particularly to FIG. 7, it may further be seen that the preferred corrugated sheet material comprises a double-faced corrugated plastic sheet material such as 4 or greater mil polyethylene having a thickness on the order of ⅛", the corrugated sheet material 14 comprising a pair of generally planar plies 16, 18 spaced apart a short distance and interconnected by an intermediate convoluted ply 20 which is integrally molded with and thermally bonded to the planar plies 16, 18 to form what may be shown diagrammatically as a multiplicity of lateral connecting sections and a multiplicity of longitudinal air pockets 22 which define a generally longitudinal grain G extending along and generally parallel with the entire length or major axis of the blank 12.

Referring again to FIG. 6, it may be seen that the blank 12 includes a generally rectangular base panel 24 having a longer or major axis with a length greater than the width of the shorter or minor axis thereof, the base panel 24 having a pair of side edges and a pair of end edges forming a perimeter or peripheral edge thereof. A pair of side wall panels 26, 28 extend from and are hingedly connected to the base panel 24 along single-scored fold lines 30 which correspond to the side edges of the base panel 24. Similarly, a pair of end wall panels 32, 34 extend from and are hingedly connected to the base panel 24 along single-scored fold lines 36 which correspond to the end edges of the base panel 24.

Each side wall panel 26, 28 has a pair of side edges 38 which taper or angle outwardly relative to the vertical centerline of the associated side wall panel 26, 28, and a top edge 40 that is generally parallel with the single-scored fold line 30 of the associated side wall panel 26, 28. Similarly, each end wall panel 32, 34 has a pair of opposing tapered side edges defined by single-scored fold lines 42 which angle outwardly relative to the vertical centerline of the associated end wall panel 32, 34 parallel with the longitudinal grain G and perpendicular to the end edge of the base panel 24, with a pair of end foldover panels 44, 46 extending from and being hingedly connected to each of the end wall panels 32, 34 along those single-scored fold lines 42. Each end foldover panel preferably has a convexly curved upper edge.

An end wall securing flap 48 extends from and is hingedly connected to each end foldover panel 44, 46 along double-scored fold lines 50 oriented generally parallel with the single-scored fold line 42 defining the adjacent side edge of the associated end wall panel 32, 34, the end wall securing flap 48 preferably having a predetermined height measured between a top edge 52 and bottom edge 54 that are generally parallel to one another.

Figure 3:
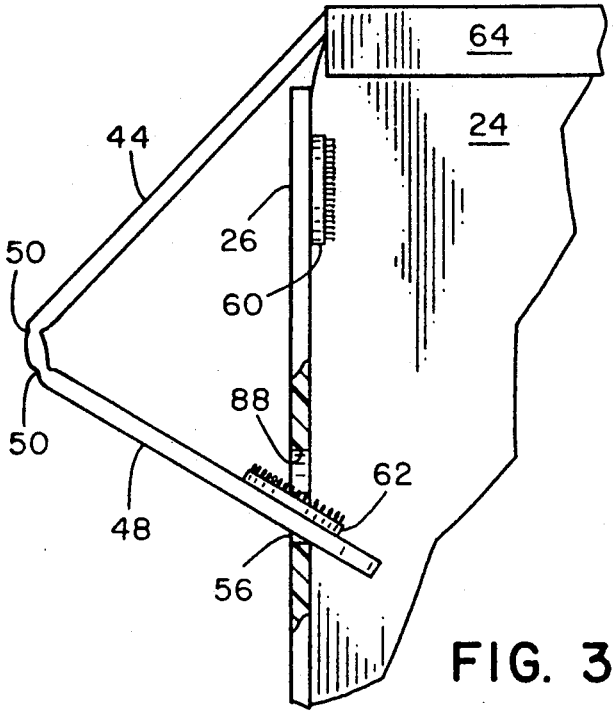
FIG. 3 is a top partial cross section view of the right rear corner of the tote container of FIG. 1 taken through line 3—3 of FIG. 1 showing the securing flap in the intermediate or partially engaged position.

The side wall panels 26, 28 are folded upwardly relative to the base panel 24 across single-scored fold line 30, and the end wall panels 32, 34 are folded upwardly relative to the base panel 24 across single-scored fold line 36, until the side edges 38 of each side wall panel 26, 28 is closely adjacent to and in parallel aligned contact with the side edge 42 of the most proximate end wall panel 32, 34 as shown in FIG. 3.

The end foldover panels 44, 46 may then be folded inwardly toward the outer planar surface of the side wall panels 26, 28 across the single-scored fold lines 42 as shown in FIG. 3, with the end wall securing flaps 48 each being bent to an acute angle of slightly less than 90° relative to the corresponding end foldover panel 44, 46.

Each side wall panel 26, 28 defines a pair of slots 56 generally aligned with the most proximate side edge 38 of the side wall panel 26, 28, the slots 56 each being positioned at the same height and aligned with the leading edge 58 of the confronting end wall securing flaps 48.

Figure 4:
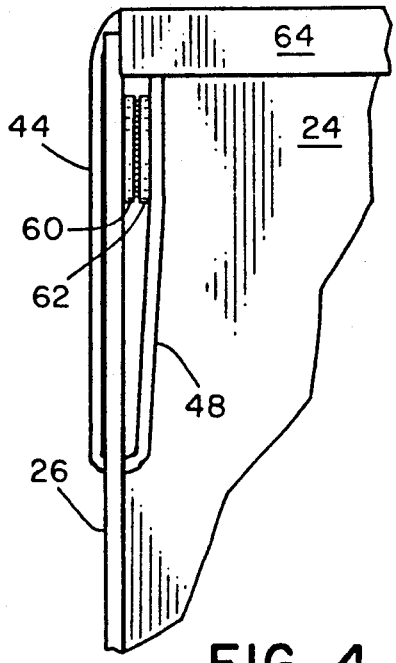
FIG. 4 is a partial top cross section view of the right rear corner of the tote container of FIG. 1 taken through line 3—3 of FIG. 1 showing the securing flap in the completely engaged or secured position.

The leading edge 58 of each end wall securing flap 48 is then inserted at least partially through the corresponding slot 56 until the end wall securing flap 48 in the intermediate or partially engaged position such as shown in FIG. 3. The end wall securing flaps 48 are then completely inserted through the corresponding slot 56 until the end foldover panels 44, 46 are in generally parallel abutting contact with the outer planar surface of the confronting side wall panel 26, 28 as shown particularly in FIG. 4, and the end wall securing flaps 48 are then folded across double-scored fold lines 50 until the end wall securing flaps 48 are in generally parallel abutting contact with the inner planar surface of the confronting side wall panel 26, 28 in the completely engaged or secured position as shown in FIG. 4.

It may be seen that attached or affixed to the inner planar surface of the each side wall panel 26, 28 in an area confined or bounded by each slot 56, and the top edge 52, bottom edge 54, and leading edge 58 of the confronting end wall securing flap 48 are one or more segments or circular patches 60 of a first mating half of a releasable fastener such as a hook and loop type fastener. Similarly attached or affixed to the surface of each end wall securing flap 48 confronting and aligned with the circular patches 60 of the first mating half of the releasable fastener are one or more segments or circular patches 62 of a second mating half of the releasable fastener. The two mating circular patches 60, 62 of the releasable fastener may be pressed into contact with one another to removably or releasably secure each of the end wall securing flaps 48 to the adjacent side wall panels 26, 28, thus securing each of the end wall panels 32, 34 to each of the side wall panels 26, 28, as may be seen in FIGS. 1 and 4.

Figure 2:
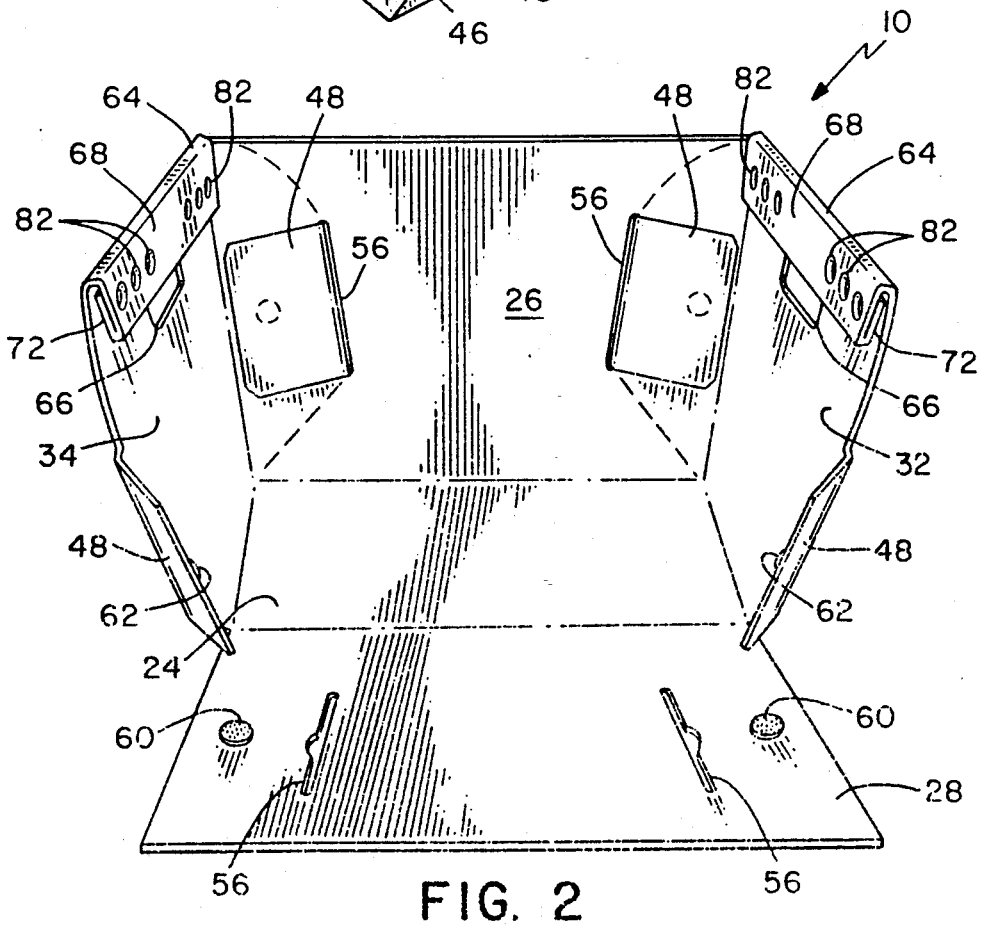
FIG. 2 is a side perspective view of the tote container of FIG. 1 showing the front side wall unfastened and folded downwardly to expose the interior receptacle region of the tote container.

Referring to FIG. 2, it may be seen that this process may be reversed, with the mating circular patches 60, 62 of the releasable fastener being disengaged so that the end wall securing flaps 48 are released or unfastened from the adjacent side wall panels 26, 28, and the end wall panels 32, 34 may be released or unfastened from the side wall panels 26, 28 so that the side wall panels 26, 28 and end wall panels 32, 34 may be folded to a generally flat or planar position as in the blank 12. Again referring to FIG. 2, it may also be seen that one of the end wall securing flaps 48 associated with each end wall panel 32, 34 may be unfastened, thereby permitting one of the side walls 26, 28 to be released or unfastened from the two end wall panels 32, 34 and folded downwardly to expose the interior receptacle region of the tote container 10.

Figure 5:
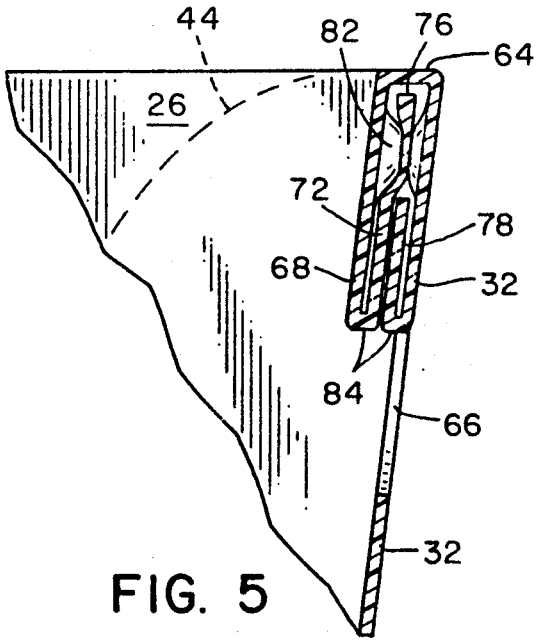
FIG. 5 is a partial side cross section view of the right end wall panel of the tote container of FIG. 1 taken through line 5—5 of FIG. 1 showing the shoulder and handgrip construction.

Referring particularly to FIGS. 1, 5, and 6, the construction of the end shoulder 64 and handgrip openings 66 for the tote container 10 may be seen. Each of the pair of end shoulders 64 is formed from a first shoulder panel 68 which extends from and is hingedly connected to the top edge of the corresponding end wall panel 32, 34 along double-scored fold lines 70, and a second shoulder panel 72 which extends from and is hingedly connected to the first shoulder panel 68 along double-scored fold lines 74. Each of the first and second shoulder panels 68, 72 extend along and generally parallel with the entire length of the top edge of the corresponding end wall panel 32, 34, with each of the second shoulder panels 72 having a height measured between the outer edge 76 and the double-scored fold lines 74 which is slightly less than the height of the first shoulder panel 72 measured between the two pair of double-scored fold lines 70, 74.

Each handgrip opening 66 is formed by partially cutting a section of the corresponding end wall panel 32, 34 along the bottom and sides of a rectangle, thereby forming a handgrip flap 78 which remains hingedly connected to the corresponding end wall panel 32, 34 at the top of the rectangle along double-scored fold lines 80. The double-scored fold lines 80 are preferably spaced apart from the double scored fold lines 70 separating the end wall panels 32, 34 from the first shoulder panels 68 a distance generally equal to the height of the first shoulder panels 68.

Referring to FIG. 5, it may be seen that each of the handgrip flaps 78 are folded inwardly and upwardly across double-scored fold lines 80 into parallel abutting contact with the interior planar surface of the corresponding end wall panel 32, 34. Each second shoulder panel 72 is folded inwardly and downwardly across double-scored fold lines 74 into parallel abutting contact with the first shoulder panel 68, and the first shoulder panel 68 and second shoulder panel 72 are folded inwardly and downwardly across double-scored fold lines 70 and into parallel abutting contact with the handgrip flap 78 and corresponding end wall panel 32, 34, such that the handgrip flaps 78 are each received between the corresponding end wall panel 32, 34 and the second shoulder panel 72. The second shoulder panel 72, first shoulder panel 68, and corresponding end wall panel 32, 34 are then securely fastened together using a conventional fastening means such as a plurality of sonic welds 82 which bond each of the second shoulder panel 72, first shoulder panel 68, and corresponding end wall panel 32, 34 together.

As such, each handgrip opening 66 presents a widened support surface 84 defined by two closed planar segments of corrugated sheet material 14 having a width equal to the combined distances between each individual pair of double-scored fold lines 70, 74, or at least the width of four thicknesses of the double-faced corrugated plastic sheet material 14.

The end shoulders 64 may also be formed on the exterior side of the corresponding end wall panels 32, 34 by folding the handrip flaps 78 outwardly and upwardly and folding the first and second shoulder panels 68, 72 outwardly and downwardly, and securing the first and second shoulder panels 68, 72 and corresponding end wall panels 32, 34 together in the manner described above with the handgrip flaps 78 disposed between the end wall panels 32, 34 and the second shoulder panels 72 but in parallel abutting contact with the exterior side of the corresponding end wall panel 32, 34.

Each of the slots 56 preferably has a pair of side edges 86 and a width measured between the side edges 86 that is equal to or slightly greater than the thickness of the corrugated sheet material 14. Each of the slots 56 preferably defines a truncated semi-circular bulged portion 88 extending outwardly from a one of said side edges 86 of the slot 56, the bulged portion 88 being sized and positioned such that the patch 62 of hook-and-loop fastener affixed to the inner planar surface of the corresponding end wall securing flap 48 will be received within and pass through the bulged portion 88 when the end wall securing flap 88 is inserted and received through the slot 56 to prevent the patch 62 from being peeled off from the end wall securing flap 88.

It may be appreciated that the dimensions and proportions of the various panels of the tote container 10 may be determined, modified, and adjusted as necessary to suit the particular needs of a specific application, as well as maximizing the ratio of corrugated sheet material 14 utilized to form the tote container versus that which is wasted. However, it has proven suitable to fabricate the blank 12 such that it is bounded by a rectangle having overall dimensions including a length of approximately 47" and a width of 33⅜", with the length or major axis of the rectangle being generally parallel with the longitudinal grain G of the double-faced corrugated plastic sheet material 14, and with the various panels and elements arranged, positioned, and dimensioned substantially proportionate to the blank 12 as depicted in FIG. 6.

While the preferred embodiment of the above tote container 10 has been described in detail with reference to the attached drawing Figures, it is understood that various changes and adaptations may be made in the tote container 10 without departing from the spirit and scope of the appended claims.

What is claimed is:

1. A tote container folded from a generally planar blank of sheet material to a generally upright tote container configuration defining an interior receptacle region, said tote container comprising:

a base panel, said base panel having a pair of side edges and a pair of end edges;

a pair of side wall panels, each of said pair of side wall panels extending from and being hingedly connected to said base panel along a one of said pair of side edges thereof, each of said pair of side wall panels having an interior planar surface; a pair of end wall panels, each of said pair of end wall panels extending from and being hingedly connected to said base panel along a one of said pair of end edges thereof, each of said pair of end wall panels having a pair of opposing side edges;

a plurality of end foldover panels, each of said plurality of end foldover panels extending from and being hingedly connected to a one of said end wall panels along a one of said pair of opposing side edges thereof, each of said plurality of end foldover panels further having an end wall securing flap extending therefrom and hingedly connected thereto, each said end wall securing flap having a height and a leading edge, each of said pair of side wall panels defining at least one slot extending entirely therethrough and positioned so as to be aligned with said leading edge of a corresponding one of said end wall securing flaps when said corresponding one of said end wall securing flaps is pivoted into close confronting relation to said side wall panel, each said slot having a height equal to or greater than said height of said end wall securing flap such that said corresponding one of said end wall securing flaps may be received through said slot aligned therewith and pivoted into parallel abutting contact with said interior planar surface of said side wall panel; and a releasable fastener, said releasable fastener being connected to said interior planar surface of each of said side wall panels or each of said end wall securing flaps or a combination thereof such that each of said end wall securing flaps may be selectively and releasably fastened to said corresponding one of said pair of side wall panels to secure said pair of side wall panels and said pair of end wall panels of the tote container in the generally upright tote container configuration.

2. The tote container of claim 1 wherein the number of the end foldover panels is four, the number of the end wall securing flaps is four, and the number of the slots is four, two of the slots being defined by each of the pair of side wall panels

3. The tote container of claim 1 wherein the side wall panels and the end wall panels of the tote container are generally outwardly tapered such that the tote container is nestable within a like tote container.

4. The tote container of claim 1 wherein the releasable fastener comprises a plurality of pairs of mating segments of a hook-and-loop type fastener.

5. The tote container of claim 4 wherein each of the plurality of pairs of mating segments of a hook-and-loop type fastener include a first patch and a second patch, said first patch being affixed to the interior planar surface of one of the side wall panels and said second patch being affixed to the corresponding one of the end wall securing flaps and aligned with and contacting said first patch when the end wall securing flap is pivoted into parallel abutting contact with the corresponding one of the side wall panels.

6. The tote container of claim 1 wherein each end foldover panel has a top edge, said top edge being generally upwardly convexly curved.

7. The tote container of claim 1 wherein the sheet material has a thickness and each of the slots has a pair of side edges and a width measured between said pair of side edges, said width being equal to or slightly greater than said thickness of the sheet material, and wherein each of the slots defines a bulged portion, said bulged portion extending outwardly from a one of said side edges of the slot, said bulged portion being sized sufficient such that the releasable fastener may be received within and pass through said bulged portion when the end wall securing flap is received through the slot.

8. In a tote container of the tapered nestable type folded from a generally planar blank of corrugated plastic sheet material to a generally upright tote container configuration defining an interior receptacle region, said tote container having a base panel, a pair of side wall panels hingedly connected to said base panel, a pair of end wall panels hingedly connected to said base panel, and a plurality of end foldover panels each hingedly connected to one of said pair of end wall panels and being pivotable into parallel abutting contact with an adjacent and confronting one of said pair of side wall panels or said pair of end wall panels or a combination thereof, the improvement comprising:

a plurality of wall securing flaps, each of said plurality of wall securing flaps extending from and being hingedly connected to one of the end foldover panels, each said wall securing flap having a height and a leading edge, said pair of said wall panels defining a plurality of slots extending entirely therethrough and positioned so as to be aligned with said leading edge of a corresponding one of said plurality of wall securing flaps when said corresponding one of said plurality of wall securing flaps is pivoted into close confronting relation thereto, each of said plurality of slots having a height equal t or greater than said height of said corresponding one of said plurality of wall securing flaps such that said corresponding one of said plurality of wall securing flaps may be received through said one of said plurality of slots aligned therewith and pivoted into parallel abutting contact with a corresponding interior planar surface of an adjacent one of the pair of side wall panels; and a releasable fastener, said releasable fastener being connected to said interior planar surface of each of said plurality of wall securing flaps such that each of said wall securing flaps may be selectively and releasably fastened to said adjacent one of the pair of side wall panels to secure the pair of side wall panels and the pair of end wall panels of the tote container in the generally upright tote container configuration.

9. The tote container of claim 8 wherein the releasable fastener comprises a plurality of pairs of mating segments of a hook-and-loop type fastener.

10. The tote container of claim 9 wherein each of the plurality of pairs of mating segments of a hook-and-loop type fastener include a first patch and a second patch, said first patch being affixed to the interior planar surface of one of the pair of side wall panels and said second patch being affixed to the corresponding one of the plurality of wall securing flaps and aligned with and contacting said first patch when the plurality of wall securing flaps are pivoted into parallel abutting contact with the adjacent one of the pair of side wall panels.

11. The tote container of claim 8 wherein the sheet material has a thickness and each of the plurality of slots has a pair of side edges and a width measured between said pair of side edges, said width being equal to or slightly greater than said thickness of the sheet material, and wherein each of the slots defines a bulged portion, said bulged portion extending outwardly from one of said side edges of the slot, said bulged portion being sized sufficient such that the releasable fastener may be received within and pass through said bulged portion when the wall securing flap is received through the slot.

12. In a tote container of the tapered nestable type folded from a generally planar blank of corrugated plastic sheet material to a generally upright tote container configuration defining an interior receptacle region, said tote container having a base panel, a first pair of opposing wall panels hingedly connected to said base panel, and a second pair of opposing wall panels hingedly connected to said base panel, said first pair of opposing wall panels each having a top edge, the improvement comprising:

a pair of handgrip openings, each of said pair of handgrip openings being formed by cutting through a section of one of the first pair of opposing wall panels to form a pair of handgrip flaps, each of said pair of handgrip flaps being hingedly connected to said one of the first pair of opposing wall panels, each of said pair of handgrip opening defining a top edge; and a pair of shoulders, said pair of shoulders being positioned proximate to the top edges of the first pair of opposing wall panels, each of said pair of shoulders including a first shoulder panel and a second shoulder panel, said first shoulder panel being hingedly connected to a one of the top edges of the first pair of opposing wall panels, said second should panel being hingedly connected to said first should panel, each of said second shoulder panels being folded into parallel abutting contact with a corresponding one of said first shoulder panels, each of said first shoulder panels being folded downwardly relative to a corresponding one of the first pair of opposing wall panels and each of the pair of handgrip flaps being folded upwardly relative to a corresponding one of the first pair of opposing wall panels such that each of said second shoulder panels are folded into parallel abutting contact with a corresponding one of said pair of handgrip flaps and the corresponding one of the first pair of opposing wall panels, with said first shoulder panels, said second shoulder panels, and said handgrip flaps being secured such that each of said pair of handgrip openings presents a widened support surface along said top edge thereof

13. The tote container of claim 12 wherein each of the widened support surfaces is defined by two closed planar segments of the corrugated plastic sheet material.

14. The tote container of claim 12 wherein the corrugated plastic sheet material has a thickness, and wherein each of the widened support surfaces has a width equal at least four times said thickness of the corrugated plastic sheet material.

15. The tote container of claim 12 wherein each of the first pair of opposing wall panels has an interior side and wherein each of the handgrip flaps and each of the shoulders are disposed generally on said interior side of the first pair of opposing wall panels.

* * * * *